US011049486B2

(12) United States Patent
Fujimaru

(10) Patent No.: US 11,049,486 B2
(45) Date of Patent: Jun. 29, 2021

(54) NOISE REDUCTION APPARATUS, NOISE REDUCTION METHOD, AND COMPUTER-READABLE RECORDING MEDIUM

(71) Applicant: Olympus Corporation, Hachioji (JP)

(72) Inventor: Masamitsu Fujimaru, Hachioji (JP)

(73) Assignee: Olympus Corporation, Tokyo (JP)

( * ) Notice: Subject to any disclaimer, the term of this patent is extended or adjusted under 35 U.S.C. 154(b) by 107 days.

(21) Appl. No.: 16/573,707

(22) Filed: Sep. 17, 2019

(65) Prior Publication Data

US 2020/0160826 A1 May 21, 2020

Related U.S. Application Data

(63) Continuation of application No. PCT/JP2018/015025, filed on Apr. 10, 2018.

(30) Foreign Application Priority Data

Apr. 24, 2017 (JP) ..... JP2017-085659

(51) Int. Cl.
*G10K 11/178* (2006.01)
*H04R 1/10* (2006.01)
*H04R 25/00* (2006.01)

(52) U.S. Cl.
CPC .. *G10K 11/17823* (2018.01); *G10K 11/17833* (2018.01); *H04R 1/1083* (2013.01); *G10K 2210/108* (2013.01)

(58) Field of Classification Search
CPC ..... G10L 21/00; G10L 21/02; G10L 21/0208; G10L 21/0216; G10L 21/0232;
(Continued)

(56) References Cited

U.S. PATENT DOCUMENTS 8,189,766 B1 * 5/2012 Klein ..... H04M 9/085 379/406.07
8,742,850 B1 * 6/2014 Fong ..... H04B 17/407 330/289
8,849,231 B1 * 9/2014 Murgia ..... H04W 52/0238 455/296
2005/0152563 A1 * 7/2005 Amada ..... G10L 21/0208 381/94.1
(Continued)

FOREIGN PATENT DOCUMENTS

JP 08-006575 1/1996
JP 2006-067355 A 3/2006
(Continued)

OTHER PUBLICATIONS

International Search Report ("ISR") from corresponding International Application No. PCT/JP2018/015025, dated Jul. 3, 2018 (4 pgs.), including the Written Opinion of the International Searching Authority (3 pgs.) and English language translation of the ISR (2 pgs.).

*Primary Examiner* — Leshui Zhang
(74) *Attorney, Agent, or Firm* — John C. Pokotylo; Pokotylo Patent Services

(57) ABSTRACT

A noise reduction apparatus includes: an input device to which an electric signal is input from an external device; a signal processing circuit configured to perform predetermined signal processing on the electric signal input to the input device and output a generated signal to an external device; a switch configured to change over to either one of a connected state in which the input device and the signal processing circuit are electrically connected to each other and a disconnected state in which the input device and the signal processing circuit are electrically disconnected to each other; and a noise processing circuit configured to subtract a noise signal output from the signal processing circuit when the switch is in the disconnected state from the
(Continued)

signal output from the signal processing circuit when the switch is in the connected state, and output a subtraction result.

16 Claims, 14 Drawing Sheets

(58) Field of Classification Search
CPC ..... H04R 3/00; H04R 3/005; H04R 29/001; H04R 1/1083; H04R 1/1041; H04R 25/603; H04R 2225/61; G10K 11/16; G10K 11/175; G10K 11/178; G10K 11/1781; G10K 11/17821; G10K 11/17823; G10K 11/1783; G10K 11/17833; G10K 11/17873; G10K 2210/108; G10K 2210/1081; G10K 2210/1082; H04N 5/23299; H04N 5/23206; G06F 3/165
USPC ..... 704/226, 227, 228, 235, 236, 238; 330/256, 266, 272, 289; 381/306, 33, 381/123; 700/94
See application file for complete search history.

(56) References Cited

U.S. PATENT DOCUMENTS

| | | | | |
|---|---|---|---|---|
| 2008/0181421 | A1* | 7/2008 | Inoue | H04M 9/082 381/66 |
| 2009/0323976 | A1* | 12/2009 | Asada | G10K 11/1783 381/71.1 |
| 2011/0144779 | A1* | 6/2011 | Janse | H04R 1/1041 700/94 |
| 2012/0250885 | A1* | 10/2012 | Yoshizuka | G10L 21/0232 381/94.2 |
| 2013/0297052 | A1* | 11/2013 | Nakata | A63F 13/424 700/94 |
| 2014/0247948 | A1* | 9/2014 | Goldstein | H04R 1/1083 381/58 |
| 2016/0086594 | A1 | 3/2016 | Asada et al. | |

FOREIGN PATENT DOCUMENTS

| | | | |
|---|---|---|---|
| JP | 2008-219164 | A | 9/2008 |
| JP | 2009-065456 | A | 3/2009 |
| JP | 2010-011117 | A | 1/2010 |

* cited by examiner

NOISE REDUCTION APPARATUS, NOISE REDUCTION METHOD, AND COMPUTER-READABLE RECORDING MEDIUM

CROSS-REFERENCE TO RELATED APPLICATION

This application is a continuation of PCT International Application No. PCT/JP2018/015025, filed on Apr. 10, 2018, which designates the United States, incorporated herein by reference, and which claims the benefit of priority from Japanese Patent Application No. 2017-085659, filed on Apr. 24, 2017, incorporated herein by reference.

BACKGROUND

1. Technical Field

The present disclosure relates to a noise reduction apparatus, a noise reduction method, and a computer-readable recording medium to reduce noise that occurs in a signal processing unit.

2. Related Art

There is a conventionally known technology of imaging devices, such as video cameras, to reduce noise due to a noise source near a microphone when stereo recording is conducted (see Japanese Laid-open Patent Publication No. 2006-67355). With this technology, out of first and second microphones, noise is reduced by subtracting a signal of a noise component obtained from the second microphone located near the noise source from a sound signal obtained from the first microphone located far from the noise source.

SUMMARY

In some embodiments, a noise reduction apparatus includes: an input device to which an electric signal is input from an external device; a signal processing circuit configured to perform predetermined signal processing on the electric signal input to the input device and output a generated signal to an external device; a switch that is provided between the input device and the signal processing circuit, the switch being configured to change over to either one of a connected state in which the input device and the signal processing circuit are electrically connected to each other and a disconnected state in which the input device and the signal processing circuit are electrically disconnected to each other; and a noise processing circuit configured to subtract a noise signal output from the signal processing circuit when the switch is in the disconnected state from the signal output from the signal processing circuit when the switch is in the connected state, and output a subtraction result.

In some embodiments, provided is a noise reduction method implemented by a noise reduction apparatus including: an input device to which an electric signal is input from an external device; a signal processing unit configured to perform predetermined signal processing on the electric signal input to the input device and output a generated signal to an external device; and a switch that is provided between the input device and the signal processing circuit, the switch being configured to change over to either one of a connected state in which the input device and the signal processing circuit are electrically connected to each other and a disconnected state in which the input device and the signal processing circuit are electrically disconnected to each other. The noise reduction method includes subtracting a noise signal output from the signal processing circuit when the switch is in the disconnected state from the signal output from the signal processing circuit when the switch is in the connected state, and outputting a subtraction result.

In some embodiments, provided is a non-transitory computer-readable recording medium with an executable program for a noise reduction apparatus stored thereon, the noise reduction apparatus including: an input device to which an electric signal is input from an external device; a signal processing unit configured to perform predetermined signal processing on the electric signal input to the input device and output a generated signal to an external device; and a switch that is provided between the input device and the signal processing circuit, the switch being configured to change over to either one of a connected state in which the input device and the signal processing circuit are electrically connected to each other and a disconnected state in which the input device and the signal processing circuit are electrically disconnected to each other. The program causes the noise reduction apparatus to execute: subtracting a noise signal output from the signal processing circuit when the switch is in the disconnected state from the signal output from the signal processing circuit when the switch is in the connected state, and outputting a subtraction result.

The above and other features, advantages and technical and industrial significance of this disclosure will be better understood by reading the following detailed description of presently preferred embodiments of the disclosure, when considered in connection with the accompanying drawings.

DETAILED DESCRIPTION

Figure 1:
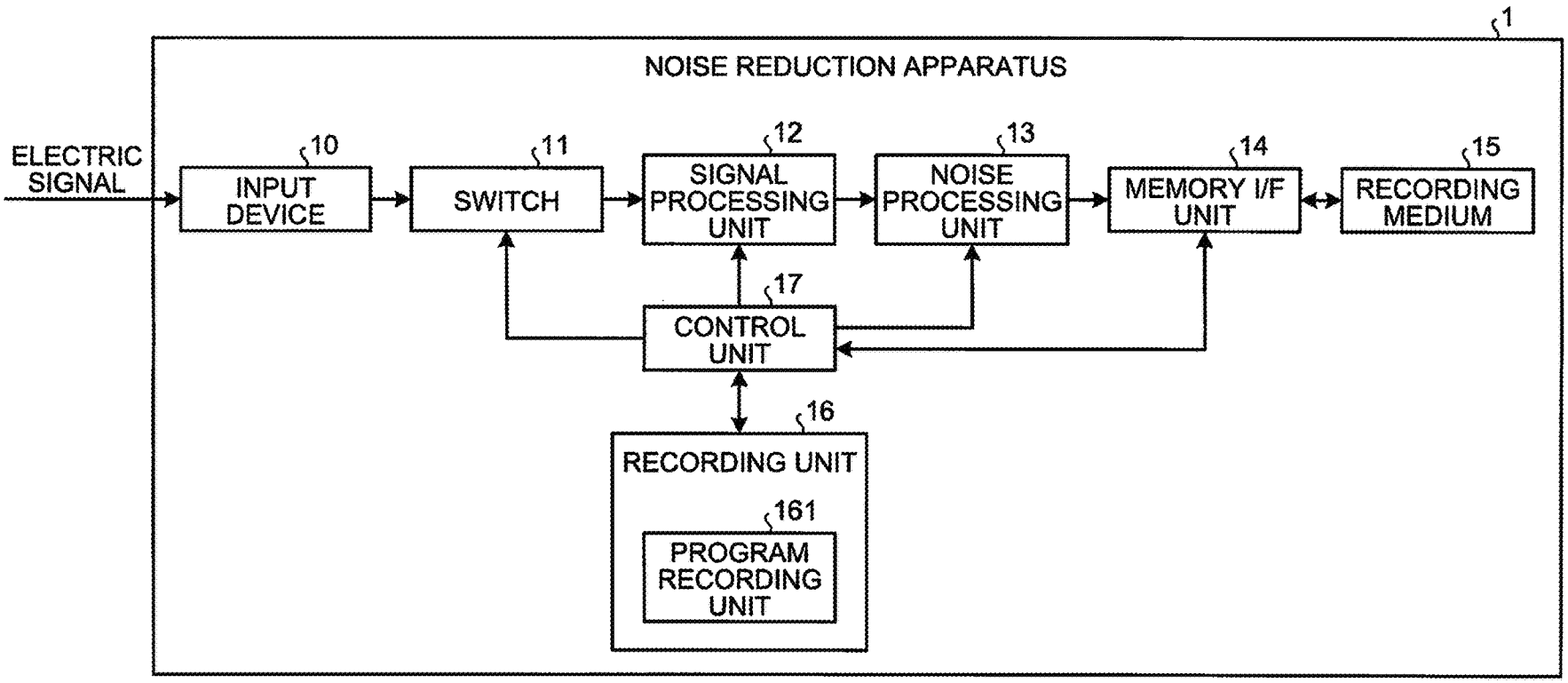
FIG. 1 is a block diagram that illustrates a functional configuration of a noise reduction apparatus according to a first embodiment of the disclosure.

Aspects (hereinafter, referred to as "embodiments") for carrying out the disclosure are explained below with reference to the drawings. Furthermore, the disclosure is not limited to the following embodiments. Moreover, in the drawings referred to in the following explanation, shapes, sizes, and positional relationships are schematically illustrated merely to understand the details of the disclosure. That is, the disclosure is not exclusively limited to the shapes, the sizes, and the positional relationships illustrated in the drawings.

First Embodiment

Noise Reduction Apparatus

FIG. 1 is a block diagram that illustrates a functional configuration of a noise reduction apparatus according to a first embodiment of the disclosure. A noise reduction apparatus 1 illustrated in FIG. 1 is used in any of the following: a sound recording and playing back device, such as an IC recorder, which acquires sound with for example a microphone, records it as sound data, and outputs the sound data from a speaker, or the like; a capturing device that is capable of recording image data generated by an imaging element, such as a CCD (Charge Coupled Device) or a CMOS (Complementary Metal Oxide Semiconductor), and displaying the image corresponding to the image data; and a headphone that plays back and outputs the sound data from an external device. The noise reduction apparatus 1 is an apparatus that removes self-noise that occurs in a codec circuit, an image processing circuit, or the like, which performs signal processing on sound data or image data. Here, the self-noise is the noise generated due to a voltage fluctuation when a device is started up or the noise peculiar to an electric circuit provided in the device even though no sound data or image data is input.

As illustrated in FIG. 1, the noise reduction apparatus 1 includes an input device 10, a switch 11, a signal processing unit 12, a noise processing unit 13, a memory I/F unit 14, a recording medium 15, a recording unit 16, and a control unit 17.

The input device 10 receives electric signals acquired by an external device. Specifically, the input device 10 receives analog or digital sound signals (electric signals) converted from the sound collected by a microphone, and analog or digital image signals (electric signals) generated by an imaging element such as CCD or CMOS. The input device 10 is configured as appropriate depending on the configuration of the noise reduction apparatus 1. For example, when a portable recording medium is used to transfer sound signals or image signals with an external device, the input device 10 is configured as a reader device that has the recording medium removably attached thereto and that reads the recorded sound signal or image signal. Furthermore, when a server that records sound signals and image signals acquired by an external device is used, the input device 10 is configured as a communication device, or the like, capable of communicating with the server in both directions and, by performing data communication with the server, acquiring a sound signal or image signal. Furthermore, the input device 10 may be configured as an interface device, or the like, to which a sound signal or image signal is input from an external device via a cable.

The switch 11 is provided between the input device 10 and the signal processing unit 12 to change over to either one of the connected state in which the input device 10 and the signal processing unit 12 are electrically connected to each other and the disconnected state in which the input device 10 and the signal processing unit 12 are electrically disconnected to each other. The switch 11 changes over to either one of the connected state and the disconnected state under the control of the control unit 17. The switch 11 is configured by using any of, for example, a mechanical switch such as a toggle switch or push switch, an analog semiconductor switch formed of an IC such as a MOS, and a mechanical relay switch formed of a MOS.

Under the control of the control unit 17, the signal processing unit 12 executes predetermined signal processing on an electric signal, input via the input device 10 and the switch 11, to generate an output signal and outputs the output signal to the noise processing unit 13. Here, the predetermined signal processing is amplification processing, A/D conversion processing, gain adjustment processing, format conversion processing for conversion into a predetermined format, and the like, for electric signals. The signal processing unit 12 is configured by using DSP (Digital Signal Processing), FPGA (Field Programmable Gate Array), or the like.

Under the control of the control unit 17, the noise processing unit 13 subtracts a noise signal output from the signal processing unit 12 when the state of the switch 11 is the disconnected state from a signal (output signal) output from the signal processing unit 12 when the state of the switch 11 is the connected state and then outputs it to the memory I/F unit 14. The noise processing unit 13 is configured by using DSP, FPGA, or the like.

Under the control of the control unit 17, the recording medium 15 records a signal (output signal) output from the noise processing unit 13 via the memory I/F unit 14. The recording medium 15 is mounted to the noise reduction apparatus 1 in an attachable and detachable manner via the memory I/F unit 14. The recording medium 15 is configured by using, for example, a memory card.

The recording unit 16 records various programs executed by the noise reduction apparatus 1 and various types of data executed by the noise reduction apparatus 1. The recording unit 16 is configured by using a Flash memory, SDRAM (Synchronous Dynamic Random Access Memory), or the like. Furthermore, the recording unit 16 includes a program recording unit 161 that records a program executed by the noise reduction apparatus 1.

The control unit 17 controls each unit included in the noise reduction apparatus 1 in an integrated manner. The control unit 17 is configured by using a CPU (Central Processing Unit), or the like. The control unit 17 controls the state of the switch 11. Furthermore, the control unit 17 controls each of the signal processing unit 12, the noise processing unit 13, and the memory I/F unit 14. Specifically, the control unit 17 changes the state of the switch 11 to any one of the connected state and the disconnected state. Furthermore, when the state of the switch 11 is the disconnected state and when there is no data from the input device 10, the control unit 17 causes the signal processing unit 12 to output a signal (noise signal) to the noise processing unit 13.

Process of the Noise Reduction Apparatus

Figure 2:
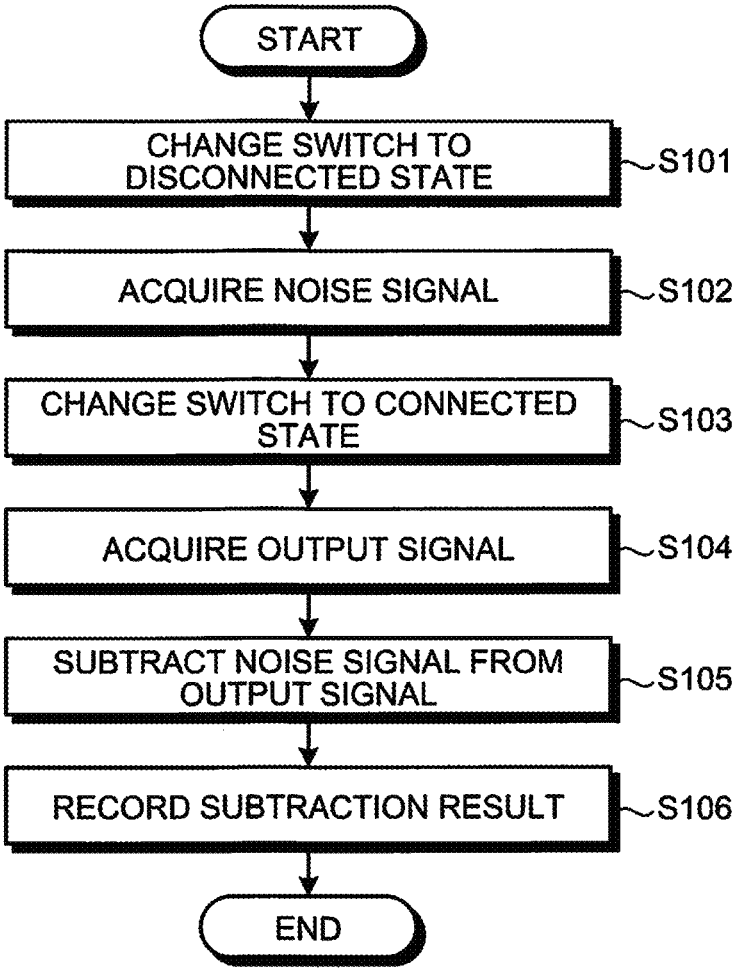
FIG. 2 is a flowchart that illustrates the outline of a process performed by the noise reduction apparatus according to the first embodiment of the disclosure.

Next, a process performed by the noise reduction apparatus 1 is explained. FIG. 2 is a flowchart that illustrates the outline of the process performed by the noise reduction apparatus 1.

As illustrated in FIG. 2, the control unit 17 first changes the state of the switch 11 to the disconnected state (Step S101) and causes the signal processing unit 12 to output a noise signal while in the disconnected state where the input device 10 and the signal processing unit 12 are disconnected to each other and in the state where no electric signal is input from the input device 10 to the signal processing unit 12, whereby the noise processing unit 13 is caused to acquire a noise signal from the signal processing unit 12 (Step S102).

Then, the control unit 17 changes the state of the switch 11 to the connected state (Step S103) and, in the connected state where the input device 10 and the signal processing unit 12 are connected to each other, causes the signal processing unit 12 to execute signal processing on an electric signal input from the input device 10 and output an output signal, whereby the noise processing unit 13 is caused to acquire the output signal from the signal processing unit 12 (Step S104).

Then, the control unit 17 causes the noise processing unit 13 to subtract the noise signal output from the signal processing unit 12 in the disconnected state where the input device 10 and the signal processing unit 12 are disconnected to each other from the output signal output from the signal processing unit 12 in the connected state where the input device 10 and the signal processing unit 12 are connected to each other (Step S105). This makes it possible to reduce at least the noise signal included in the signal processing unit 12 from the output signal.

Then, the control unit 17 records a subtraction result, which is obtained after the noise processing unit 13 has removed the noise signal from the output signal, in the recording medium 15 via the memory I/F unit 14 (Step S106). After Step S106, the noise reduction apparatus 1 terminates this process.

According to the first embodiment of the disclosure described above, as the noise processing unit 13 subtracts a noise signal output from the signal processing unit 12 when the state of the switch 11 is the disconnected state from an output signal output from the signal processing unit 12 when the state of the switch 11 is the connected state and then outputs it, whereby it is possible to reduce the self-noise occurring in the noise reduction apparatus 1 from the output signal.

Furthermore, according to the first embodiment of the disclosure, the noise processing unit 13 may cause the recording unit 16 to record a noise signal output from the signal processing unit 12 when the state of the switch 11 is the disconnected state.

Second Embodiment

Next, a second embodiment of the disclosure is explained. According to the second embodiment, the noise reduction apparatus is applied to a sound recording device including a microphone. After the configuration of the sound recording device according to the second embodiment is explained below, a process performed by the sound recording device according to the second embodiment is explained. Furthermore, the same component as that in the noise reduction apparatus 1 according to the above-described first embodiment is attached with the same reference numeral, and a detailed explanation is omitted.

Configuration of the Sound Recording Device

Figure 3:
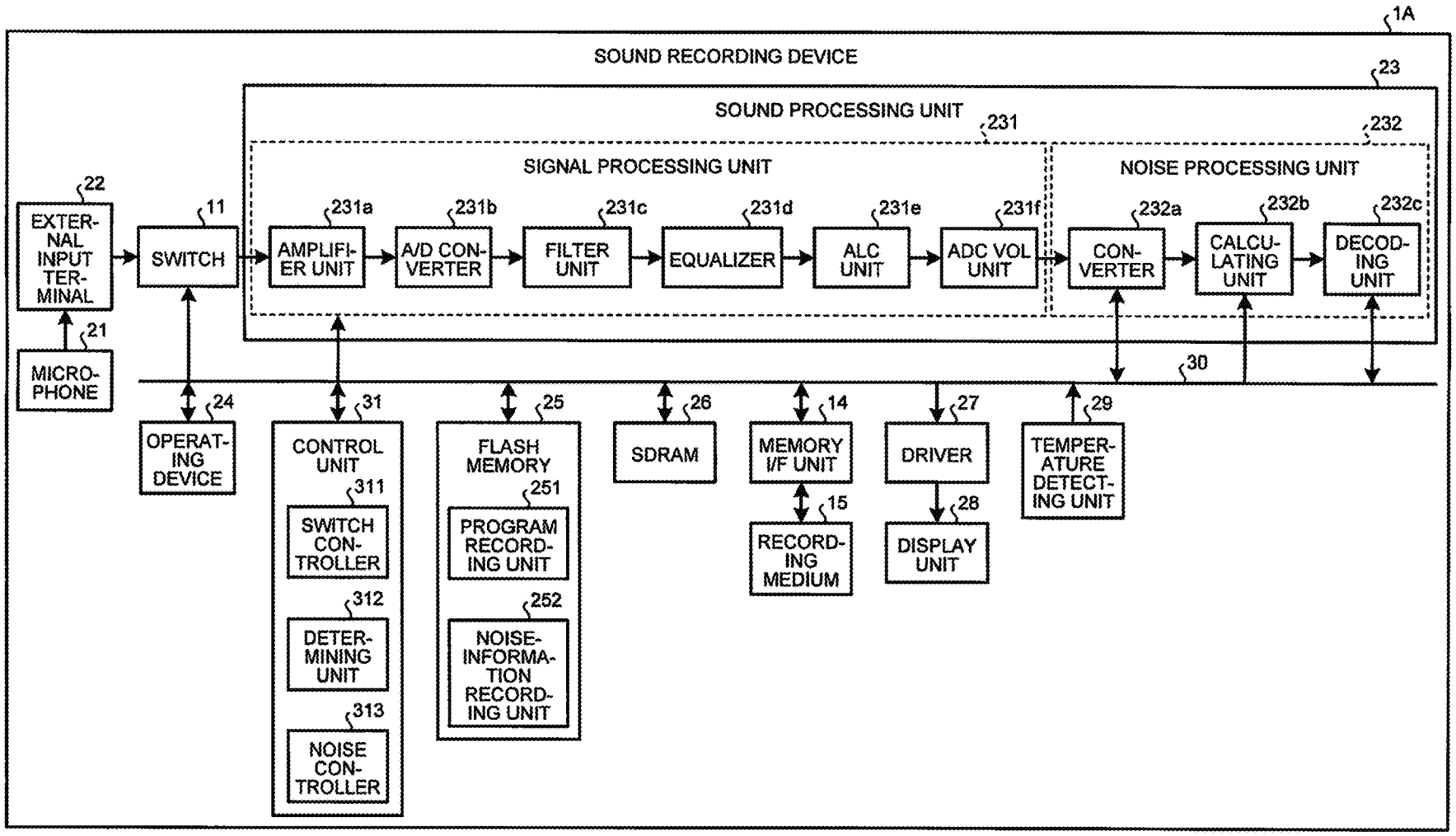
FIG. 3 is a block diagram that illustrates a functional configuration of a sound recording device according to a second embodiment of the disclosure.

FIG. 3 is a block diagram that illustrates a functional configuration of the sound recording device according to the second embodiment of the disclosure. A sound recording device 1A illustrated in FIG. 3 is a device that collects sound, generates a sound signal (electric signal) based on the collected sound, and records it.

As illustrated in FIG. 3, the sound recording device 1A includes a microphone 21, an external input terminal 22, the switch 11, a sound processing unit 23, an operating device 24, a Flash memory 25, an SDRAM 26, the memory I/F unit 14, the recording medium 15, a driver 27, a display unit 28, a temperature detecting unit 29, a bus 30, and a control unit 31.

The microphone 21 receives sound, converts it into an analog sound signal (electric signal), and outputs the sound signal to the sound processing unit 23 via the external input terminal 22 and the switch 11. In the explanation according to the second embodiment, the microphone 21 is a directional microphone; however, this is not a limitation, and it may be a unidirectional microphone and, furthermore, a microphone with changeable directional characteristic may be used. Further, the microphone 21 may be a stereo microphone capable of collecting right and left sound. Moreover, according to the second embodiment, the microphone 21 functions as a first microphone.

The plug of an external microphone is inserted into the external input terminal 22. The external input terminal 22 receives input of an analog sound signal (electric signal) converted from the sound by the external microphone and outputs the received sound signal to the sound processing unit 23 via the switch 11. Furthermore, the microphone 21 is electrically connected to the external input terminal 22. The external input terminal 22 electrically connects the external microphone and the switch 11 when the plug of the external microphone is inserted into the external input terminal 22 and electrically connects the microphone 21 and the switch 11 when the plug of the external microphone is not inserted into the external input terminal 22. The external input terminal 22 is configured by using a microphone jack, or the like. Furthermore, according to the second embodiment, the external microphone functions as a second microphone.

Figure 4:
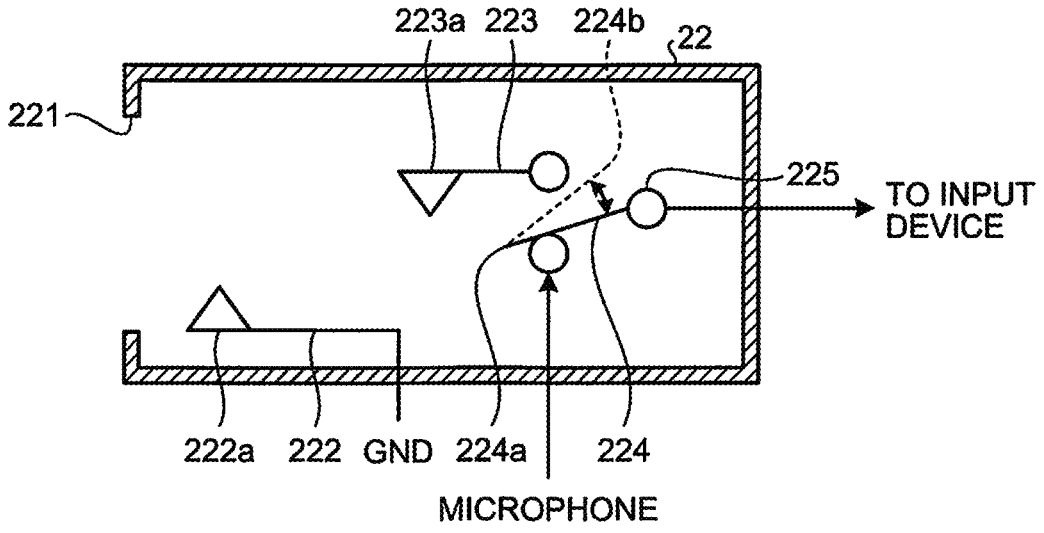
FIG. 4 is a cross-sectional view that schematically illustrates a configuration of an external input terminal included in the sound recording device according to the second embodiment of the disclosure.

FIG. 4 is a cross-sectional view that schematically illustrates a configuration of the external input terminal 22.

As illustrated in FIG. 4, the external input terminal 22 includes an insertion portion 221, a first contact member 222, a second contact member 223, and a third contact member 224.

The plug of the external microphone is inserted into the insertion portion 221. A first end of the first contact member 222 is grounded (GND). When the plug of the external microphone is inserted into the insertion portion 221, a second end 222*a* of the first contact member 222 is brought into contact with it to be electrically connected. A first end of the second contact member 223 is electrically connected to the switch 11 via an undepicted circuit. When the plug of the external microphone is inserted into the insertion portion 221, a second end 223*a* of the second contact member 223 is brought into contact with it to be electrically connected. A first end 224*a* of the third contact member 224 is electrically connected to the microphone 21, a second end 224*b* is electrically connected to the switch 11, and when the plug of the external microphone is inserted into the insertion portion 221, the second end 224*b* is electrically disconnected from the switch 11. Specifically, when the plug of the external microphone is inserted into the insertion portion 221, the first end 224*a* of the third contact member 224 is brought into contact with the plug of the external microphone so that the second end 224*b* is separated from a terminal 225, whereby the microphone 21 and the switch 11 are electrically disconnected. Furthermore, the configuration of the external input terminal 22 may be changed as appropriate to other than the shape illustrated in FIG. 4. Furthermore, although the microphone 21 is electrically connected to the switch 11 via the external input terminal 22 according to the second embodiment, this is not a limitation, and the microphone 21 and the switch 11 may have a direct electrical connection by omitting the configuration of the external input terminal 22.

With reference back to FIG. 3, the configuration of the sound recording device 1A is continuously explained.

Under the control of the control unit 31, the sound processing unit 23 performs various types of signal processing on a sound signal (electric signal) input via the switch 11. Under the control of the control unit 31, the sound processing unit 23 records the sound signal (output signal), on which signal processing has been performed, in the recording medium 15 via the bus 30 and the memory I/F unit 14. Specifically, under the control of the control unit 31, the sound processing unit 23 converts a sound signal into sound data in a predetermined format on a frame-by-frame basis and temporarily records it in the SDRAM 26. For example, under the control of the control unit 31, the sound processing unit 23 continuously performs the operations for the above-described conversion into sound data and the recording of the sound data in the SDRAM 26 during recording and sequentially records the sound data, recorded in the SDRAM 26, in the recording medium 15 in a FIFO (First In First Out) manner. The sound processing unit 23 is configured by using DSP, FPGA, or the like. The sound processing unit 23 includes a signal processing unit 231 and a noise processing unit 232. Furthermore, according to the second embodiment, the sound processing unit 23 functions as a noise reduction apparatus.

Under the control of the control unit 31, the signal processing unit 231 performs predetermined signal processing on a sound signal (electric signal) and outputs it to the noise processing unit 232. The signal processing unit 231 includes at least an amplifier unit 231*a*, an A/D converter 231*b*, a filter unit 231*c*, an equalizer 231*d*, an ALC (Automatic Level Control) unit 231*e*, and an ADC Vol unit 231*f*.

Under the control of the control unit 31, the amplifier unit 231*a* amplifies the sound signal, input via the switch 11, and outputs it to the A/D converter 231*b*. The amplifier unit 231*a* is configured by using an amplifier circuit such as an amplifier. Furthermore, according to the second embodiment, the amplifier unit 231*a* functions as an amplifying unit.

Under the control of the control unit 31, the A/D converter 231*b* conducts A/D conversion on the analog sound signal, input from the amplifier unit 231*a*, to convert it into a digital sound signal (quantized data) and outputs the digital sound signal to the filter unit 231*c*. The A/D converter 231*b* is configured by using an A/D conversion circuit, or the like.

The filter unit 231*c* cuts off an unnecessary frequency from the digital sound signal, input from the A/D converter 231*b*, and outputs it to the equalizer 231*d*. The filter unit 231*c* is configured by using, for example, a low-pass filter circuit.

Under the control of the control unit 31, the equalizer 231*d* adjusts a specific frequency with regard to the digital sound signal input from the filter unit 231*c* and outputs it to the ALC unit 231*e*. The equalizer 231*d* is configured by using various filters.

Under the control of the control unit 31, the ALC unit 231*e* automatically controls the gain of the sound signal and outputs it to the ADC Vol unit 231*f*. The ALC unit 231*e* is configured by using an ALC circuit, or the like.

Under the control of the control unit 31, the ADC Vol unit 231*f* amplifies the digital sound signal, input from the ALC unit 231*e*, and outputs it to the noise processing unit 232. The ADC Vol unit 231*f* is configured by using an ADC Vol circuit, or the like.

Under the control of the control unit 31, the noise processing unit 232 reduces noise included in the sound signal (output signal) input from the sound processing unit 23. Under the control of the control unit 31, the noise processing unit 232 records the sound signal with reduced noise in the SDRAM 26 via the bus 30 or in the recording medium 15 via the bus 30 and the memory I/F unit 14. The noise processing unit 232 is provided after the signal processing unit 231. The noise processing unit 232 includes a converter 232*a*, a calculating unit 232*b*, and a decoding unit 232*c*.

Under the control of the control unit 31, the converter 232*a* generates first amplitude information by conducting discrete Fourier transform (hereafter, simply referred to as "DFT process") on a signal (noise signal) output from the signal processing unit 231 when the switch 11 sets the state between the external input terminal 22 and the signal processing unit 231 to the disconnected state. Specifically, the converter 232*a* generates the first amplitude information by performing the DFT process on a digital signal (noise signal) output from the signal processing unit 231. Furthermore, under the control of the control unit 31, the converter 232*a* records the first amplitude information in the Flash memory 25 or the SDRAM 26 via the bus 30 or records it in the recording medium 15 via the bus 30 and the memory I/F unit 14. Furthermore, under the control of the control unit 31, the converter 232*a* generates second amplitude information by conducting the DFT process on a digital sound signal output from the signal processing unit 231 when the switch 11 sets the state between the external input terminal 22 and the signal processing unit 231 to the connected state and outputs the second amplitude information to the calculating unit 232*b*. Specifically, the converter 232*a* generates second phase information by conducting the DFT process on a digital sound signal output from the signal processing unit 231 and generates the second amplitude information based on the second phase information.

Under the control of the control unit 31, the calculating unit 232*b* calculates the difference between the second amplitude information input from the converter 232*a*and the first amplitude information recorded in the Flash memory 25 or the SDRAM 26 and outputs the difference to the decoding unit 232*c*. Specifically, under the control of the control unit 31, the calculating unit 232*b* subtracts the first amplitude information recorded in the SDRAM 26 from the second amplitude information input from the converter 232*a* and outputs the subtraction result to the decoding unit 232*c*.

Under the control of the control unit 31, the decoding unit 232*c* conducts inverse Fourier transform (hereafter, simply referred to as "IDFT process") on the difference calculated by the calculating unit 232*b* to generate a decoded sound signal (decoded signal) with noise reduced. Specifically, the decoding unit 232*c* decodes the signal based on the difference between the second amplitude information and the first amplitude information and the second phase information. Under the control of the control unit 31, the decoding unit 232*c* records the decoded sound signal in the recording medium 15 via the bus 30 and the memory I/F unit 14.

The operating device 24 receives input of signals for giving commands for various operations related to the sound recording device 1A. The operating device 24 outputs received command signals to the control unit 31 via the bus 30. For example, the operating device 24 receives input of a start signal for giving a command to the sound recording device 1A so as to start recording, a termination signal for giving a command to terminate recording, a switch signal for changing over to any of modes (e.g., multiple recording modes) executable by the sound recording device 1A, an adjustment signal for adjusting the gain of a sound signal, and the like. The operating device 24 is configured by using a button, arrow key, switch, touch panel, and the like. It is obvious that the operating device 24 may form a graphical user interface (GUI), or the like, by using a touch panel, a display monitor, and the like.

The Flash memory 25 includes: a program recording unit 251 that records a program executed by the sound recording device 1A; and a noise-information recording unit 252 that records the noise information relating multiple sets of first amplitude information generated by the converter 232*a* and the temperature detected by the temperature detecting unit 29 described later. Furthermore, the Flash memory 25 records various parameters, and the like, regarding the sound recording device 1A.

Figure 5:
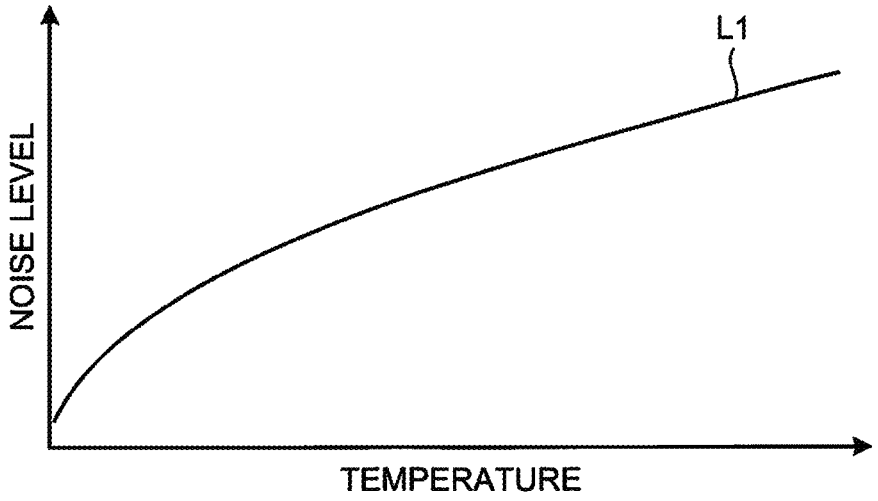
FIG. 5 is a diagram that schematically illustrates an example of noise information recorded in a noise-information recording unit included in the sound recording device according to the second embodiment of the disclosure.

FIG. 5 is a diagram that schematically illustrates an example of the noise information recorded in the noise-information recording unit 252. In FIG. 5, the horizontal axis indicates a temperature, the vertical axis indicates a noise level, and a curved line L1 indicates the relation between the temperature and the noise level. As illustrated in the curved line L1 of FIG. 5, the noise-information recording unit 252 records the first amplitude information (noise level) for each temperature. Although the first amplitude information is related to every temperature in a continuous manner in FIG. 5, this is not a limitation, and the temperature detected by the temperature detecting unit 29 described later and the first amplitude information may be recorded by being related discretely.

With reference back to FIG. 3, the configuration of the sound recording device 1A is continuously explained.

The SDRAM 26 temporarily records various types of information that is being processed by the sound recording device 1A. Furthermore, the SDRAM 26 temporarily records the first amplitude information generated by the converter 232*a*.

Under the control of the control unit 31, the driver 27 controls the display mode of the display unit 28. For example, under the control of the control unit 31, the driver 27 causes the display unit 28 to present the gain with regard to a sound signal, the volume of a sound signal, the recording time of a sound signal, and the like.

The display unit 28 is configured by using a display panel such as liquid crystal or organic EL (Electro Luminescence), and it displays information input from the driver 27.

The temperature detecting unit 29 detects the ambient temperature of the sound recording device 1A. The temperature detecting unit 29 outputs a detection result to the control unit 31 via the bus 30. The temperature detecting unit 29 is configured by using a temperature sensor, or the like.

The bus 30 is the transmission path that connects each component in the sound recording device 1A, and it transmits various types of data generated inside the sound recording device 1A to each component in the sound recording device 1A.

The control unit 31 controls overall units included in the sound recording device 1A. The control unit 31 is configured by using a general-purpose processor such as a CPU or a dedicated processor such as various arithmetic circuits performing a specific function, e.g., ASIC (Application Specific Integrated Circuit) or FPGA. When the control unit 31 is a general-purpose processor, it transmits commands, data, and the like, to each unit included in the sound recording device 1A by reading various programs stored in the program recording unit 251 and controls the overall operation of the sound recording device 1A in an integrated manner. Furthermore, when the control unit 31 is a dedicated processor, the processor may independently execute various processes, or the processor and the program recording unit 251 may execute various processes in cooperation or in combination by using various types of data, and the like, recorded in the program recording unit 251. The control unit 31 includes a switch controller 311, a determining unit 312, and a noise controller 313.

The switch controller 311 controls the state of the switch 11. Specifically, the switch controller 311 changes the state of the switch 11 to the disconnected state before the sound recording device 1A starts recording or after the sound recording device 1A terminates recording. Furthermore, if a start signal is input from the operating device 24, the switch controller 311 changes the state of the switch 11 to the connected state after a certain time period has elapsed.

The determining unit 312 determines whether the first amplitude information related to the current temperature detected by the temperature detecting unit 29 is recorded in the noise-information recording unit 252 of the Flash memory 25.

In accordance with a determination result of the determining unit 312, the noise controller 313 selects the first amplitude information used for a calculation operation by the calculating unit 232*b* from the sets of first amplitude information recorded in the Flash memory 25 and outputs it to the calculating unit 232*b*.

Figure 6:
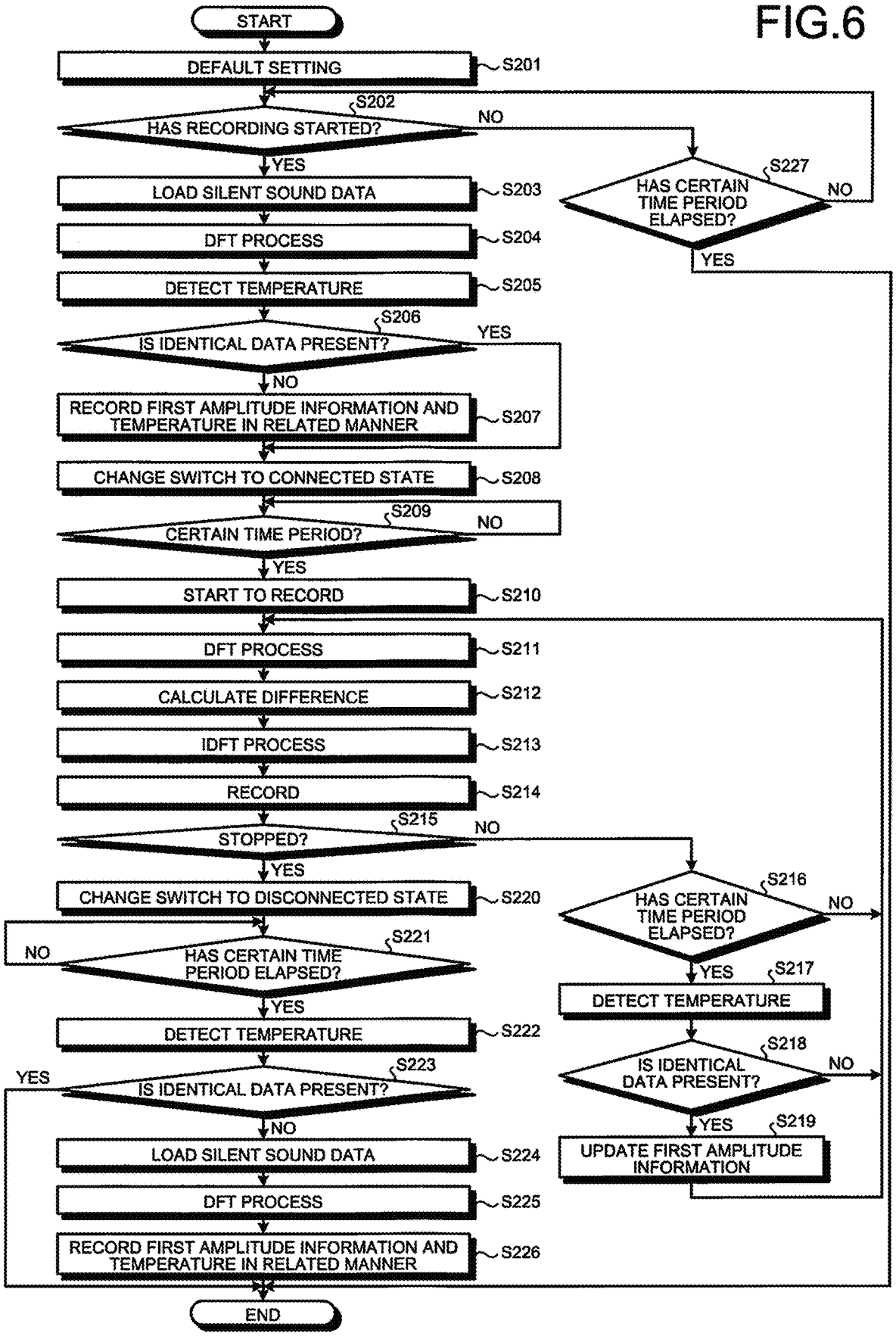
FIG. 6 is a flowchart that illustrates the outline of a process performed by the sound recording device according to the second embodiment of the disclosure.
Figure 7:
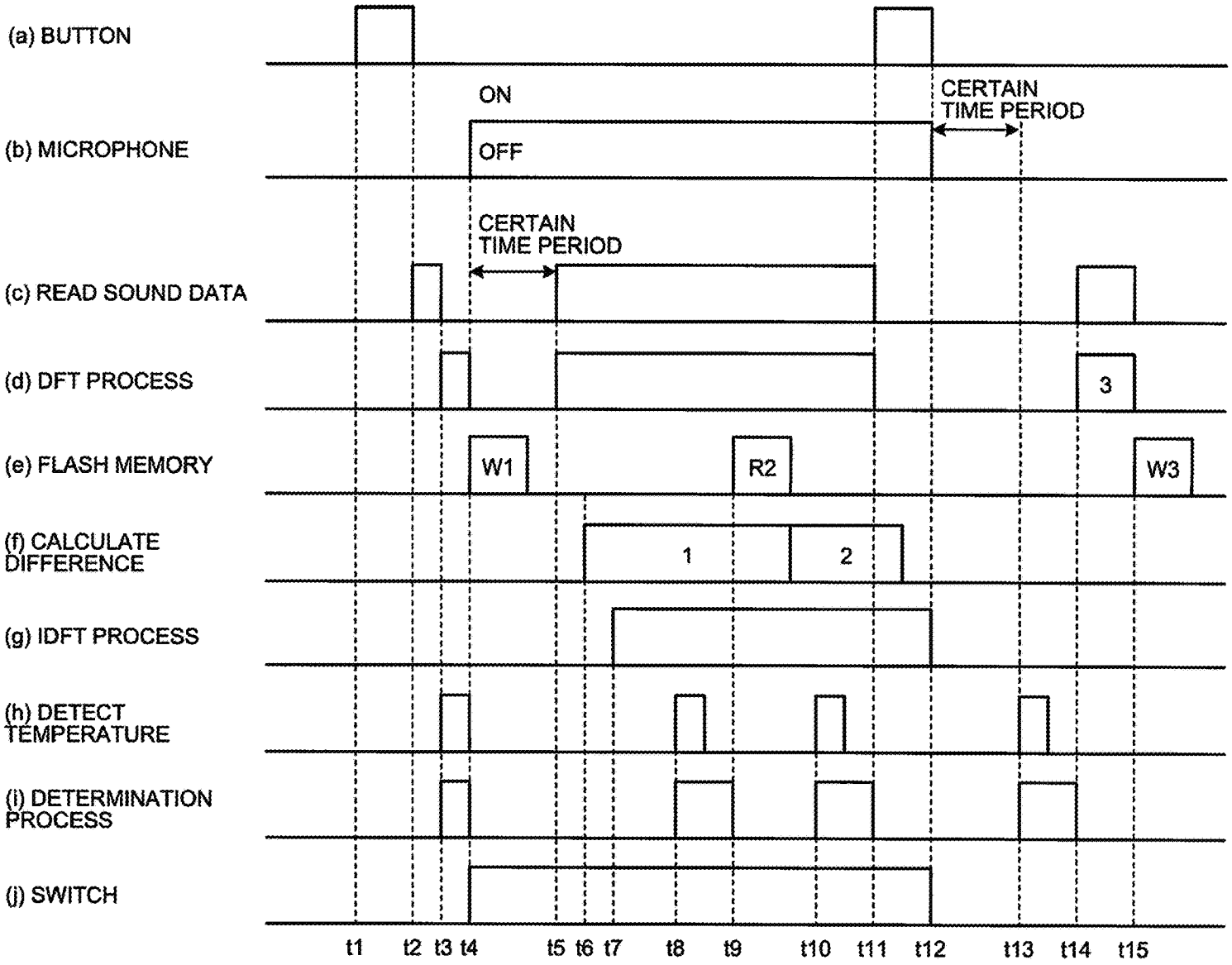
FIG. 7 is a timing chart of a process performed by the sound recording device according to the second embodiment of the disclosure.

Process of the sound recording device Next, a process performed by the sound recording device 1A is explained. FIG. 6 is a flowchart that illustrates the outline of the process performed by the sound recording device 1A. FIG. 7 is a timing chart of the process performed by the sound recording device 1A. In FIG. 7, from the upper end, (a) represents the timing of on/off operation of the operating device 24, (b)

represents the sound collection timing of the microphone 21, (c) represents the reading timing of a sound signal, (d) represents the timing of the DFT process by the converter 232*a*, (e) represents the timing of writing or reading the first amplitude information to or from the Flash memory 25, (f) represents the timing of a difference calculation process by the calculating unit 232*b*, (g) represents the timing of the IDFT process by the decoding unit 232*c*, (h) represents the timing of the temperature detection by the temperature detecting unit 29, (i) represents the determination timing by the determining unit 312, and (j) represents the state of the switch 11. Furthermore, in FIG. 7, the horizontal axis indicates a time.

As illustrated in FIG. 6, first, when the power button of the operating device 24 is operated and the sound recording device 1A is started up, the control unit 31 makes various default settings regarding the sound recording device 1A (Step S201). Here, the default settings include checking the presence or absence of a sound file recorded in the recording medium 15, checking the remaining amount of battery, setting the time and date, and the like. In this case, the switch controller 311 changes the state of the switch 11 to the disconnected state.

Then, when a start signal is input due to an operation on the operating device 24 so that sound recording is started (Step S202: Yes), the control unit 31 causes the signal processing unit 231 to output a noise signal and causes the converter 232*a* to load silent sound data (Step S203), causes the converter 232*a* to perform the DFT process on a noise signal that is silent sound data input from the signal processing unit 231 (Step S204), and causes the temperature detecting unit 29 to detect the temperature (Step S205). Specifically, as illustrated in FIG. 7, when the recording button of the operating device 24 is operated and a start signal is input (time t1), the control unit 31 causes the signal processing unit 231 to output a noise signal and causes the converter 232*a* to load silent sound data (time t2), causes the converter 232*a* to perform the DFT process on the noise signal that is silent sound data input from the signal processing unit 231 (time t3), and causes the temperature detecting unit 29 to detect the temperature (the time t3).

Figure 8:
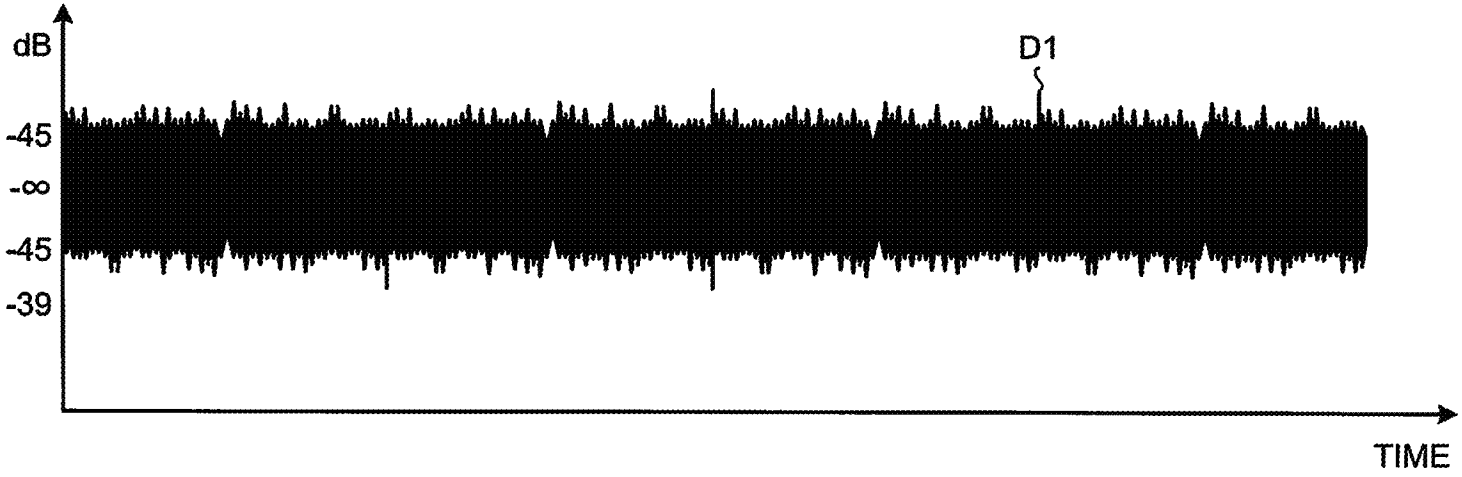
FIG. 8 is a diagram that schematically illustrates an example of silent sound data.
Figure 9:
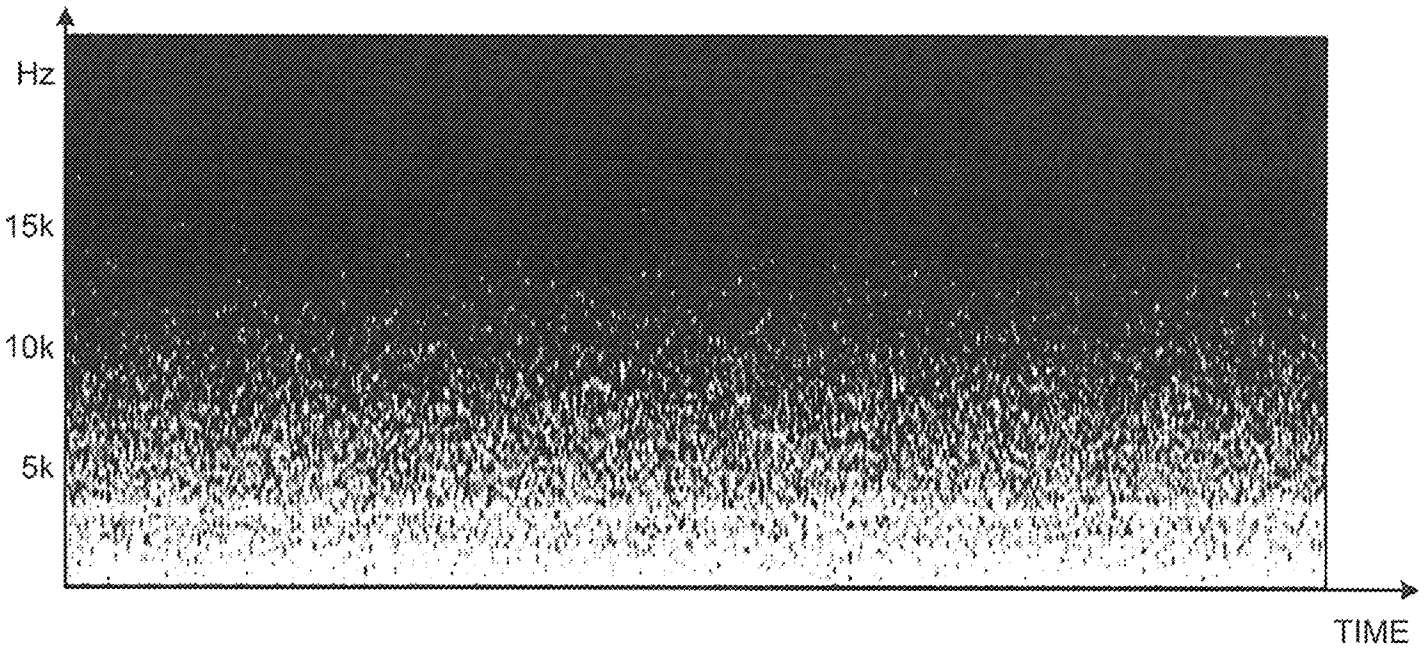
FIG. 9 is a diagram that schematically illustrates an example of the noise distribution of silent sound data when a converter included in the sound recording device according to the second embodiment of the disclosure performs a DFT process.

FIG. 8 is a diagram that schematically illustrates an example of silent sound data. FIG. 9 is a diagram that schematically illustrates an example of the noise distribution of the silent sound data when the converter 232*a* performs the DFT process. In FIG. 8, the horizontal axis indicates time, the vertical axis indicates a noise level, and a wavelength D1 indicates the noise signal that is silent sound data. In FIG. 9, the horizontal axis indicates a time, and the vertical axis indicates a frequency (Hz).

As illustrated in FIG. 8, when the recording button of the operating device 24 is operated, the control unit 31 causes the signal processing unit 231 to output a noise signal and causes the converter 232*a* to load silent sound data (the wavelength D1) and, as illustrated in FIG. 9, causes the converter 232*a* to perform the DFT process on the noise signal that is the silent sound data input from the signal processing unit 231.

With reference back to FIG. 6, the process after Step S206 is continuously explained.

At Step S206, the determining unit 312 determines whether the first amplitude information identical to the data related to the temperature detected by the temperature detecting unit 29 is recorded in the Flash memory 25. Specifically, as illustrated in FIG. 7, the determining unit 312 determines whether the first amplitude information identical to the data related to the temperature detected by the temperature detecting unit 29 is recorded in the Flash memory 25 (the time t3). When the determining unit 312 determines that the first amplitude information identical to the data related to the temperature detected by the temperature detecting unit 29 is recorded in the Flash memory 25 (Step S206: Yes), the sound recording device 1A proceeds to Step S208 described later. Conversely, when the determining unit 312 determines that the first amplitude information identical to the data related to the temperature detected by the temperature detecting unit 29 is not recorded in the Flash memory 25 (Step S206: No), the sound recording device 1A proceeds to Step S207 described later.

At Step S207, the control unit 31 records the first amplitude information generated by the converter 232*a* and the temperature detected by the temperature detecting unit 29 in a related manner in the Flash memory 25. Specifically, as illustrated in FIG. 7, the control unit 31 records the first amplitude information generated by the converter 232*a* and the temperature detected by the temperature detecting unit 29 in a related manner in the Flash memory 25 (time t4). After Step S207, the sound recording device 1A proceeds to Step S208 described later.

Then, the switch controller 311 changes the state of the switch 11 to the connected state (Step S208). Specifically, as illustrated in FIG. 7, the switch controller 311 changes the state of the switch 11 to the connected state (the time t4).

Then, when a certain time period has elapsed (Step S209: Yes), the sound recording device 1A proceeds to Step S210 described later. Conversely, when the certain time period has not elapsed (Step S209: No), the sound recording device 1A stands by until the certain time period has elapsed. Here, the reason for the standby until the certain time period (e.g., 0.5 seconds) has elapsed is to prevent the recording of noise that occurs when an electric current is applied after the sound recording device 1A is started up.

At Step S210, the control unit 31 causes the signal processing unit 231 to start to record the sound signal from the microphone 21. Specifically, as illustrated in FIG. 7, the control unit 31 causes the signal processing unit 231 to start to record the sound signal (time t5).

Then, the control unit 31 causes the converter 232*a* to sequentially perform the DFT process on sound signals output from the signal processing unit 231 in sequence (Step S211). Specifically, as illustrated in FIG. 7, the control unit 31 causes the converter 232*a* to perform the DFT process on a sound signal output from the signal processing unit 231 (the time t5).

Then, the control unit 31 causes the calculating unit 232*b* to sequentially calculate the difference between the second amplitude information input from the converter 232*a* in sequence and the first amplitude information recorded in the Flash memory 25 (Step S212). Specifically, as illustrated in FIG. 7, the control unit 31 causes the calculating unit 232*b* to sequentially calculate the difference between the second amplitude information input from the converter 232*a* in sequence and the first amplitude information recorded in the Flash memory 25 (time t6).

Figure 10:
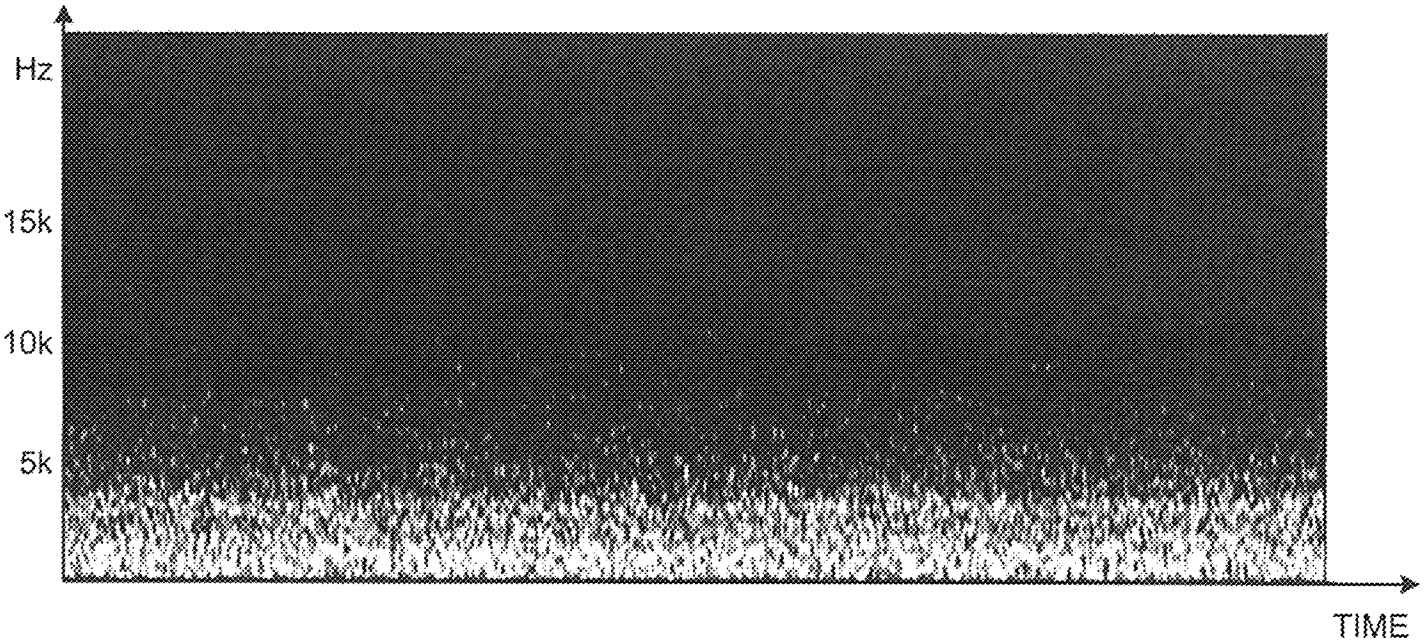
FIG. 10 is a diagram that schematically illustrates an example of the noise distribution of a calculation result by a calculating unit included in the sound recording device according to the second embodiment of the disclosure.

FIG. 10 is a diagram that schematically illustrates an example of the noise distribution of a calculation result by the calculating unit 232*b*. In FIG. 10, the horizontal axis indicates a time, and the vertical axis indicates a frequency (Hz). As illustrated in FIG. 10, the calculating unit 232*b* subtracts the first amplitude information from the second amplitude information input from the converter 232*a*, thereby reducing a noise signal included in the second amplitude information.

After Step S212, the control unit 31 causes the decoding unit 232*c* to sequentially perform the IDFT process on the difference input from the calculating unit 232*b* (Step S213). Specifically, as illustrated in FIG. 7, the control unit 31 causes the decoding unit 232*c* to sequentially perform the IDFT process on the difference input from the calculating unit 232*b* (time t7).

Figure 11:
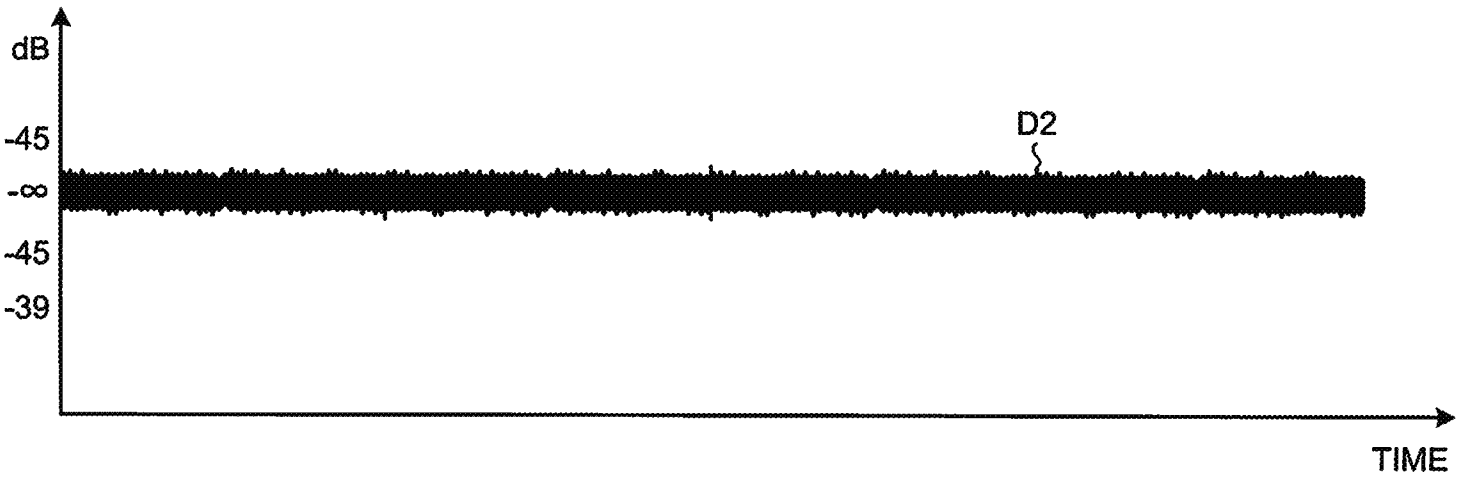
FIG. 11 is a diagram that schematically illustrates a sound signal having undergone an IDFT process by a decoding unit included in the sound recording device according to the second embodiment of the disclosure.
Figure 12:
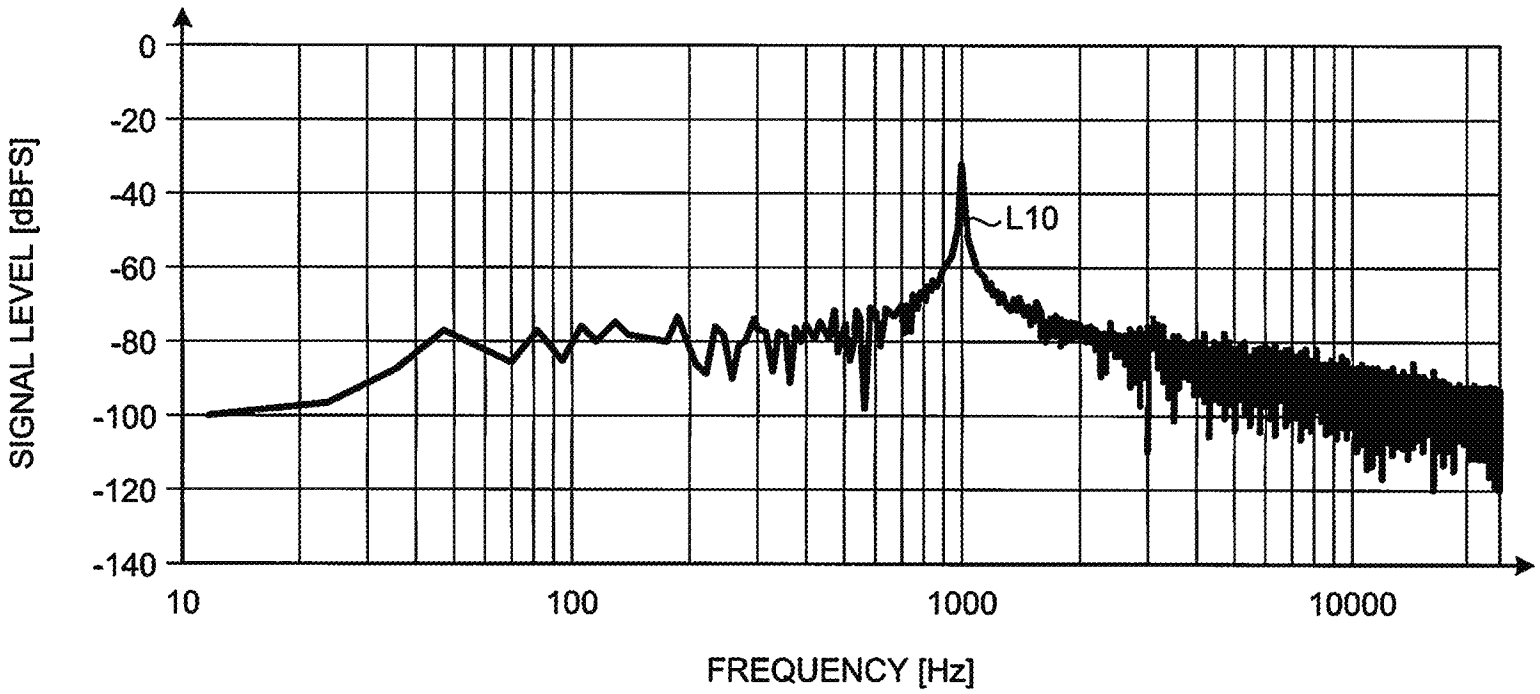
FIG. 12 is a diagram that illustrates data of a 1-kHz signal before noise removal.
Figure 13:
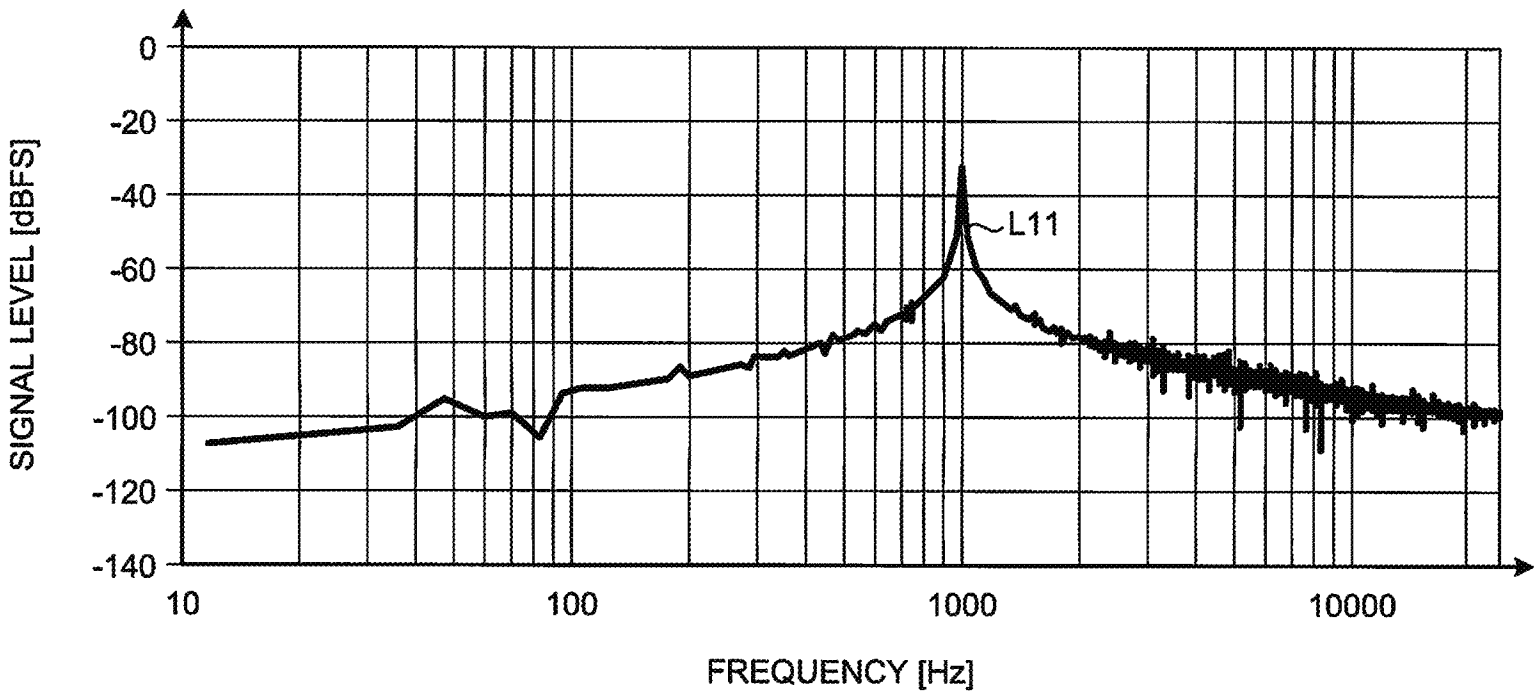
FIG. 13 is a diagram that illustrates data of a 1-kHz signal after noise removal.

FIG. 11 is a diagram that schematically illustrates a sound signal having undergone the IDFT process by the decoding unit 232*c*. FIG. 12 illustrates data of a 1-kHz signal before noise removal. FIG. 13 illustrates data of a 1-kHz signal after noise removal. In FIG. 11, the horizontal axis indicates a time, the vertical axis indicates a noise level, and a wavelength D2 indicates a sound signal. In FIG. 12 and FIG. 13, the horizontal axis indicates a frequency [Hz], and the vertical axis indicates a signal level [dBFS]. In FIG. 12, a wavelength L10 indicates the 1-kHz signal before noise removal. Furthermore, in FIG. 13, a wavelength L11 indicates the 1-kHz signal after noise removal.

As illustrated in the wavelength D2 of FIG. 11, the noise has been reduced in the sound signal having undergone the IDFT process by the decoding unit 232*c*. Specifically, as illustrated in FIG. 12 and FIG. 13, it is understood that noise has been removed with little effect on the level of the recorded sound (1 KHz). This allows a reduction in the self-noise that occurs in the sound recording device 1A.

With reference back to FIG. 6, the process after Step S214 is continuously explained.

At Step S214, the control unit 31 records the sound signal decoded by the decoding unit 232*c* in the recording medium 15 via the memory I/F unit 14.

Then, when the operating device 24 is operated and the recording of the sound recording device 1A is stopped (Step S215: Yes), the sound recording device 1A proceeds to Step S220 described later. Specifically, as illustrated in FIG. 7, when the operating device 24 is operated, the recording of the sound recording device 1A is stopped (time t11). Conversely, when the operating device 24 is not operated and the recording of the sound recording device 1A is not stopped (Step S215: No), the sound recording device 1A proceeds to Step S216 described later.

At Step S216, when a certain time period has elapsed after the temperature detecting unit 29 detects the temperature (Step S216: Yes), the control unit 31 causes the temperature detecting unit 29 to detect the temperature (Step S217). Specifically, as illustrated in FIG. 7, the control unit 31 causes the temperature detecting unit 29 to detect the temperature (time t8).

Then, the determining unit 312 determines whether the first amplitude information identical to the data related to the temperature detected by the temperature detecting unit 29 is recorded in the Flash memory 25 (Step S218). Specifically, as illustrated in FIG. 7, the determining unit 312 determines whether the first amplitude information identical to the data related to the temperature detected by the temperature detecting unit 29 is recorded in the Flash memory 25 (time t9). When the determining unit 312 determines that the first amplitude information identical to the data related to the temperature detected by the temperature detecting unit 29 is recorded in the Flash memory 25 (Step S218: Yes), the sound recording device 1A proceeds to Step S219 described later. Conversely, when the determining unit 312 determines that the first amplitude information identical to the data related to the temperature detected by the temperature detecting unit 29 is not recorded in the Flash memory 25 (Step S218: No), the sound recording device 1A proceeds to the above-described Step S211.

At Step S219, the noise controller 313 updates the first amplitude information used by the calculating unit 232*b* to the first amplitude information related to the temperature detected by the temperature detecting unit 29. Specifically, as illustrated in FIG. 7, the noise controller 313 updates the first amplitude information used by the calculating unit 232*b* to the first amplitude information (R2) related to the temperature detected by the temperature detecting unit 29. This allows the calculating unit 232*b* to subtract the first amplitude information (R2) related to the current temperature from the second amplitude information generated by the converter 232*a*. After Step S219, the sound recording device 1A returns to the above-described Step S211 and, until the recording is stopped, repeatedly performs the above-described Step S211 to Step S219. In this case, as illustrated in FIG. 7, in the sound recording device 1A, each time a certain time period has elapsed, the temperature detecting unit 29 detects the temperature (time t10), the determining unit 312 determines whether the first amplitude information identical to the data related to the temperature detected by the temperature detecting unit 29 is recorded in the Flash memory 25 (the time t10) and, when the first amplitude information identical to the data related to the temperature detected by the temperature detecting unit 29 is recorded in the Flash memory 25, the first amplitude information is applied to the calculating unit 232*b*. Furthermore, when the above-described Step S211 to Step S219 are repeatedly performed, the sound processing unit 23 converts a sound signal into sound data in a predetermined format on a frame-by-frame basis, shifts frames such that the frames are overlapped with each other, and connects sets of sound data (e.g., sound data 1, sound data 2) in a smooth manner while executing the Overlap-add method for addition by applying a weight with a window function, thereby loading a sound signal with noise reduced.

At Step S216, the sound recording device 1A returns to the above-described Step S211 when a certain time period has not elapsed after the temperature detecting unit 29 detects the temperature (Step S216: No).

At Step S220, the switch controller 311 changes the state of the switch 11 to the disconnected state. Specifically, as illustrated in FIG. 7, the switch controller 311 changes the state of the switch 11 to the disconnected state (time t12).

Then, when a certain time period has elapsed (Step S221: Yes), the control unit 31 causes the temperature detecting unit 29 to detect the temperature (Step S222). Specifically, as illustrated in FIG. 7, the control unit 31 causes the temperature detecting unit 29 to detect the temperature (time t13). After Step S222, the sound recording device 1A proceeds to Step S223 described later. Conversely, when the certain time period has not elapsed (Step S221: No), the sound recording device 1A stands by until the certain time period has elapsed.

Then, the determining unit 312 determines whether the first amplitude information identical to the data related to the temperature detected by the temperature detecting unit 29 is recorded in the Flash memory 25 (Step S223). Specifically, as illustrated in FIG. 7, the determining unit 312 determines whether the first amplitude information identical to the data related to the temperature detected by the temperature detecting unit 29 is recorded in the Flash memory 25 (time t13). When the determining unit 312 determines that the first amplitude information identical to the data related to the temperature detected by the temperature detecting unit 29 is recorded in the Flash memory 25 (Step S223: Yes), the sound recording device 1A terminates this process. Conversely, when the determining unit 312 determines that the first amplitude information identical to the data related to the temperature detected by the temperature detecting unit 29 is not recorded in the Flash memory 25 (Step S223: No), the sound recording device 1A proceeds to Step S224 described later.

At Step S224, the control unit 31 causes the signal processing unit 231 to output a noise signal and causes the converter 232*a* to load silent sound data. Specifically, as illustrated in FIG. 7, the control unit 31 causes the signal processing unit 231 to output a noise signal and causes the converter 232*a* to load silent sound data (time t14).

Then, the control unit 31 causes the converter 232*a* to perform the DFT process on the noise signal that is the silent sound data input from the signal processing unit 231 (Step S225). Specifically, as illustrated in FIG. 7, the control unit 31 causes the converter 232*a* to perform the DFT process on the noise signal that is the silent sound data input from the signal processing unit 231 (the time t14).

Then, the control unit 31 records the first amplitude information generated by the converter 232*a* and the temperature detected by the temperature detecting unit 29 in a related manner in the Flash memory 25 (Step S226). After Step S226, the sound recording device 1A terminates this process.

At Step S202, when the recording of sound is not started without inputting a start signal due to an operation on the operating device 24 (Step S202: No), the sound recording device 1A proceeds to Step S227 described later.

Then, when a certain time period has elapsed (Step S227: Yes), the sound recording device 1A terminates this process. Conversely, when the certain time period has not elapsed (Step S227: No), the sound recording device 1A returns to Step S202.

According to the above-described second embodiment of the disclosure, the noise processing unit 232 subtracts the noise signal output from the signal processing unit 231 when the state of the switch 11 is the disconnected state from the output signal output from the signal processing unit 231 when the state of the switch 11 is the connected state and outputs it, whereby it is possible to reduce self-noise occurring in the sound recording device 1A from a sound signal.

Furthermore, according to the second embodiment of the disclosure, as the switch controller 311 sets the state of the switch 11 to the disconnected state, the noise processing unit 232 may acquire self-noise occurring in the sound recording device 1A in a silent sound state; thus, the first amplitude information, which is noise, may be acquired with a simple configuration.

Furthermore, according to the second embodiment of the disclosure, as each of the sound recording devices 1A is capable of acquiring the first amplitude information that is noise, self-noise may be reduced with high accuracy without preparing various types of data.

Furthermore, according to the second embodiment of the disclosure, the calculating unit 232*b* calculates the difference between the second amplitude information input from the converter 232*a* and the first amplitude information, whereby self-noise occurring in the sound recording device 1A may be reduced from a sound signal.

Furthermore, according to the second embodiment of the disclosure, as the temperature detected by the temperature detecting unit 29 and the first amplitude information generated by the converter 232*a* are recorded in a related manner in the Flash memory 25, the first amplitude information may be acquired for each temperature.

Furthermore, according to the second embodiment of the disclosure, the calculating unit 232*b* acquires the first amplitude information related to the current temperature detected by the temperature detecting unit 29 from the Flash memory 25 and uses the acquired first amplitude information to calculate the difference between the second amplitude information and the first amplitude information, whereby it is possible to reduce noise in accordance with the usage environment of the sound recording device 1A.

Furthermore, according to the second embodiment of the disclosure, when the determining unit 312 determines that the first amplitude information related to the current temperature detected by the temperature detecting unit 29 is not recorded in the Flash memory 25, the Flash memory 25 records the current temperature detected by the temperature detecting unit 29 and the first amplitude information in a related manner, whereby the first amplitude information may be sequentially updated in accordance with the usage environment of the sound recording device 1A.

Furthermore, according to the second embodiment of the disclosure, when the determining unit 312 determines that the first amplitude information related to the current temperature detected by the temperature detecting unit 29 is not recorded in the Flash memory 25, the calculating unit 232*b* may calculate the difference between the second amplitude information and the first amplitude information by using the first amplitude information related to the temperature closest to the current temperature recorded in the Flash memory 25. This makes it possible to reduce self-noise occurring in the sound recording device 1A from a sound signal.

Figure 14:
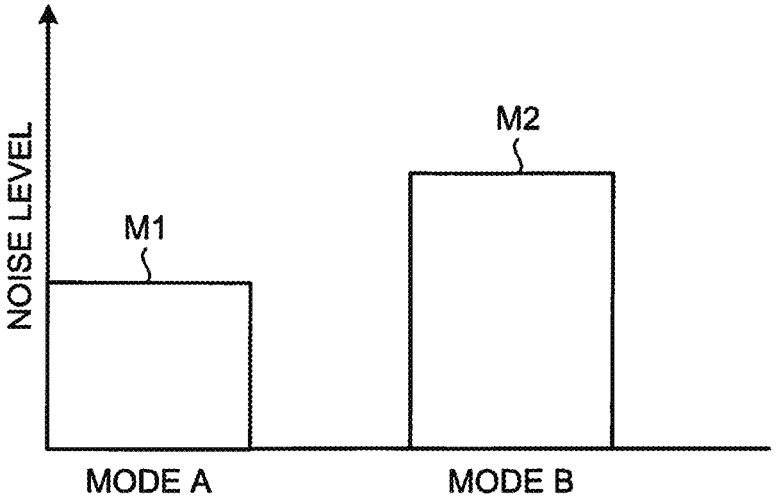
FIG. 14 is a diagram that schematically illustrates another example of noise information recorded in the noise-information recording unit included in the sound recording device according to the second embodiment of the disclosure.

Furthermore, according to the second embodiment of the disclosure, the first amplitude information generated by the converter 232*a* and the temperature detected by the temperature detecting unit 29 are recorded in a related manner in the Flash memory 25; however, this is not a limitation and, for example, each of the recording modes executable by the sound recording device 1A may be related to first amplitude information. For example, as illustrated in FIG. 14, the control unit 31 may relate first amplitude information (noise level M1, M2) generated by the converter 232*a* to each of recording modes (e.g., mode A, mode B) of the sound recording device 1A in accordance with a designation signal whose input has been received by the operating device 24 and record them in the Flash memory 25. Thus, even when a different load is applied to the sound processing unit 23 depending on a different mode and a power fluctuation is different, noise may be reduced in an optimal way for each mode.

Figure 15:
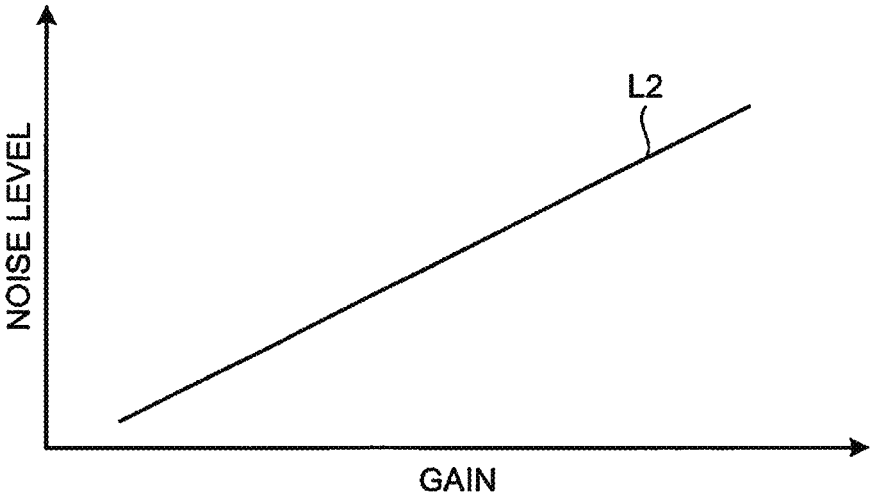
FIG. 15 is a diagram that schematically illustrates another example of noise information recorded in the noise-information recording unit included in the sound recording device according to the second embodiment of the disclosure.

Furthermore, according to the second embodiment of the disclosure, the amplification factor of the amplifier unit 231*a* and the first amplitude information generated by the converter 232*a* may be recorded in a related manner in the Flash memory 25. Specifically, as illustrated by a curved line L2 in FIG. 15, the control unit 31 may record the amplification factor of the amplifier unit 231*a* and the first amplitude information generated by the converter 232*a* in a related manner in the Flash memory 25. This allows a reduction in noise in an optimal way for each gain.

Figure 16:
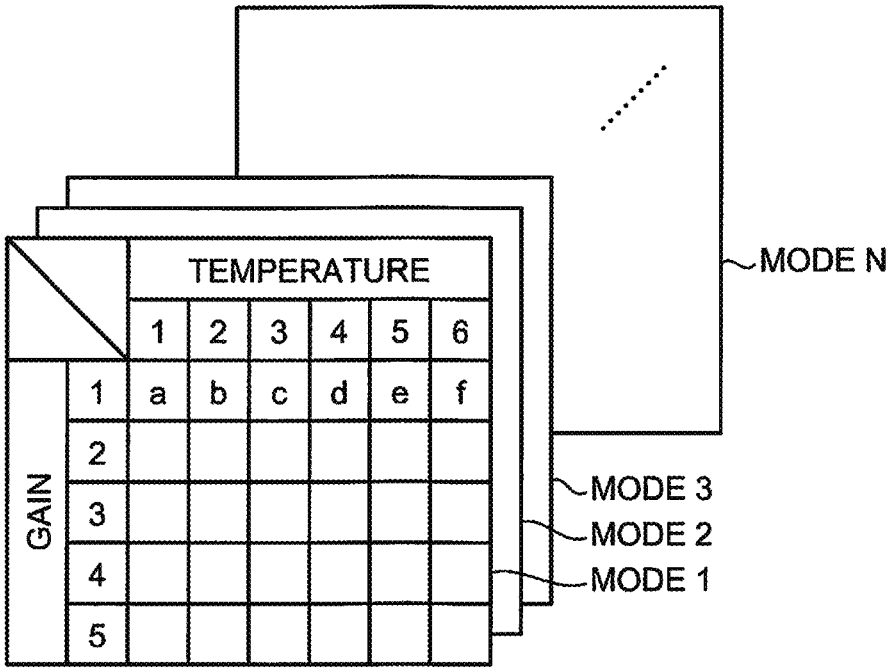
FIG. 16 is a diagram that schematically illustrates another example of noise information recorded in the noise-information recording unit included in the sound recording device according to the second embodiment of the disclosure.

Furthermore, according to the second embodiment of the disclosure, the first amplitude information generated by the converter 232*a*, the temperature detected by the temperature detecting unit 29, the amplification factor of the amplifier unit 231*a*, and multiple recording modes executable by the sound recording device 1A may be recorded in a related manner in the Flash memory 25. Specifically, as illustrated in FIG. 16, the control unit 31 records the first amplitude information generated by the converter 232*a*, the temperature detected by the temperature detecting unit 29, the amplification factor of the amplifier unit 231*a*, and multiple modes executable by the sound recording device 1A in a related manner in the Flash memory 25. This allows a reduction in noise in accordance with various conditions.

Other Embodiments

Furthermore, the noise reduction apparatus according to the disclosure is applicable to digital still cameras, digital video cameras, mobile phones having a capturing function, tablet-type electronic devices having a capturing function, medical systems that generate image data for medical and industrial fields, captured by a headphone, endoscope, or microscope, and the like, as well as sound recording devices.

Furthermore, a program executed by the noise reduction apparatus according to the disclosure is provided by being recorded, in the form of file data that is installable and executable, in a recording medium readable by a computer, such as a CD-ROM, a flexible disk (FD), a CD-R, a DVD (Digital Versatile Disk), a USB medium, or a flash memory.

Furthermore, for explanations of the flowchart and the timing chart in this description, a sequential order of operations at the respective steps is indicated by using terms such as "first", "next", and "then"; however, the sequential order of an operation necessary to implement the disclosure is not uniquely defined by using those terms. That is, the order of operations in the flowchart and the timing chart described in this description may be changed to such a degree that there is no contradiction.

Furthermore, the disclosure is not limited to the above-described embodiment as it is, and at the embodiment phase, components may be modified and embodied without departing from the scope of the disclosure. Further, the components disclosed in the above-described embodiment may be combined as appropriate to form various disclosures. For example, some components may be deleted from the entire components described in the above-described embodiment. Furthermore, the components described in each embodiment may be combined as appropriate.

Furthermore, in the description and drawings, if a term is described together with a different term having a broader meaning or the same meaning at least once, it may be replaced with the different term in any part of the description or drawings. Thus, various modifications and applications are possible without departing from the scope of the disclosure.

Thus, the disclosure may include various embodiments not described here, and various design changes, and the like, may be made within the range of technical ideas specified in claims.

According to the disclosure, there is an advantage such that it is possible to reduce self-noise that occurs in a device.

Additional advantages and modifications will readily occur to those skilled in the art. Therefore, the disclosure in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A noise reduction apparatus comprising:

an input device to which an electric signal produced from a sound signal or an image signal, is input from an external device;

a signal processing circuit configured to perform predetermined signal processing on the electric signal input to the input device and output a processed signal;

a switch that is provided between the input device and the signal processing circuit, the switch being configured to change over to either one of (A) a connected state in which the input device and the signal processing circuit are electrically connected to each other and (B) a disconnected state in which the input device and the signal processing circuit are electrically disconnected from each other; and a noise processing circuit configured to subtract a first processed signal output from the signal processing circuit when the switch is in the disconnected state, from a second processed signal output from the signal processing circuit when the switch is in the connected state, to generate a subtraction result, and output the subtraction result.

2. The noise reduction apparatus according to claim 1, wherein the noise processing circuit includes:

a converter configured to generate first amplitude information by conducting a Fourier transform on the first processed signal output from the signal processing circuit when the switch is in the disconnected state and generate second amplitude information by conducting the Fourier transform on the second processed signal output from the signal processing circuit when the switch is in the connected state;

a calculating circuit configured to calculate a difference between the second amplitude information and the first amplitude information; and a decoding circuit configured to decode a signal by conducting an inverse Fourier transform on the difference calculated by the calculating circuit and output the decoded signal as the subtraction result.

3. The noise reduction apparatus according to claim 2, wherein the signal processing circuit includes an A/D converter configured to conduct an A/D conversion on at least the electric signal, the converter is configured to generate the first amplitude information and the second amplitude information by conducting the Fourier transform on the first processed signal and the second processed signal, respectively, the first processed signal and the second processed signal being digital signals, and the decoding circuit is configured to decode a signal that is a digital signal by conducting the inverse Fourier transform on the difference and output the decoded signal.

4. The noise reduction apparatus according to claim 2, further comprising a first microphone configured to convert the sound signal into the electric signal, wherein the input device is configured to receive the electric signal from the first microphone.

5. The noise reduction apparatus according to claim 2, further comprising an external input terminal to which a microphone is connected in an attachable and detachable manner and that is electrically connected to the input device, the second microphone converting the sound signal into the electric signal, wherein the input device is configured to receive the electric signal via the external input terminal.

6. The noise reduction apparatus according to claim 2, further comprising:

a temperature sensor configured to detect an ambient temperature of the noise reduction apparatus; and a memory configured to record the ambient temperature detected by the temperature sensor and the first amplitude information in a related manner.

7. The noise reduction apparatus according to claim 6, wherein the calculating circuit is configured to (1) acquire, from the memory, the first amplitude information related to a current ambient temperature detected by the temperature sensor, and (2) use the acquired first amplitude information to calculate the difference.

8. The noise reduction apparatus according to claim 7, further comprising a determining circuit configured to determine whether the first amplitude information related to the current ambient temperature detected by the temperature sensor is recorded in the memory, wherein when the determining circuit determines that the first amplitude information related to the current ambient temperature detected by the temperature sensor is not recorded in the memory, the memory records the current ambient temperature and the first amplitude information in a related manner.

9. The noise reduction apparatus according to claim 6, further comprising a determining circuit configured to determine whether the first amplitude information related to a current ambient temperature detected by the temperature sensor is recorded in the memory, wherein when the determining circuit determines that the first amplitude information related to the current ambient temperature detected by the temperature sensor is not recorded in the memory, the calculating circuit uses the first amplitude information related to a temperature closest to the current ambient temperature to calculate the difference.

10. The noise reduction apparatus according to claim 2, further comprising:

an operating device configured to receive input of a designation signal for designating a mode of the noise reduction apparatus; and a memory configured to record the mode corresponding to the designation signal whose input is received by the operating device and the first amplitude information in a related manner.

11. The noise reduction apparatus according to claim 2, wherein the signal processing circuit further includes an amplifying circuit configured to amplify the electric signal, and the noise reduction apparatus further comprises a memory configured to record an amplification factor of the amplifying circuit and the first amplitude information in a related manner.

12. The noise reduction apparatus according to claim 4, further comprising:

a sound recording circuit configured to record the output of the noise processing circuit, wherein the converter is configured to acquire the first amplitude information before the noise reduction apparatus starts recording by the sound recording circuit.

13. The noise reduction apparatus according to claim 4, further comprising:

a sound recording circuit configured to record the output of the noise processing circuit, wherein the converter is configured to acquire the first amplitude information after the noise reduction apparatus terminates recording by the sound recording circuit.

14. The noise reduction apparatus according to claim 1, wherein the noise processing circuit is provided after the signal processing circuit.

15. A noise reduction method implemented by a noise reduction apparatus including:

an input device to which an electric signal produced from a sound signal or an image signal, is input from an external device;

a signal processing circuit configured to perform predetermined signal processing on the electric signal input to the input device and output a processed signal; and a switch that is provided between the input device and the signal processing circuit, the switch being configured to change over to either one of (A) a connected state in which the input device and the signal processing circuit are electrically connected to each other and (B) a disconnected state in which the input device and the signal processing circuit are electrically disconnected from each other, the noise reduction method comprising subtracting a first processed signal output from the signal processing circuit when the switch is in the disconnected state, from a second processed signal output from the signal processing circuit when the switch is in the connected state, to generate a subtraction result, and outputting the subtraction result.

16. A non-transitory computer-readable recording medium with an executable program for a noise reduction apparatus stored thereon, the noise reduction apparatus including:

an input device to which an electric signal produced from a sound signal or an image signal, is input from an external device;

a signal processing circuit configured to perform predetermined signal processing on the electric signal input to the input device and output a processed signal; and a switch that is provided between the input device and the signal processing circuit, the switch being configured to change over to either one of (A) a connected state in which the input device and the signal processing circuit are electrically connected to each other and (B) a disconnected state in which the input device and the signal processing circuit are electrically disconnected from each other, the executable program causing the noise reduction apparatus to execute:

subtracting a first processed signal output from the signal processing circuit when the switch is in the disconnected state, from a second processed signal output from the signal processing circuit when the switch is in the connected state, to generate a subtraction result, and outputting the subtraction result.

* * * * *